US007416296B2

(12) United States Patent
Takeda et al.

(10) Patent No.: US 7,416,296 B2
(45) Date of Patent: Aug. 26, 2008

(54) PLATEN PLATE AND LIQUID DISCHARGING DEVICE

(75) Inventors: Hiromitsu Takeda, Tokyo (JP); Shigeyoshi Hirashima, Kanagawa (JP); Toshiki Kagami, Tokyo (JP); Atsushi Oda, Kanagawa (JP); Katsuhisa Ono, Tokyo (JP); Yoshiaki Haba, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/561,697

(22) PCT Filed: Jul. 2, 2004

(86) PCT No.: PCT/JP2004/009775

§ 371 (c)(1),
(2), (4) Date: Nov. 28, 2006

(87) PCT Pub. No.: WO2005/002862

PCT Pub. Date: Jan. 13, 2005

(65) Prior Publication Data

US 2007/0109384 A1 May 17, 2007

(30) Foreign Application Priority Data

Jul. 4, 2003 (JP) ..... P 2003-191819
Jul. 4, 2003 (JP) ..... P 2003-191820

(51) Int. Cl.
*B41J 2/01* (2006.01)

(52) U.S. Cl. ..... 347/104; 400/656; 400/648

(58) Field of Classification Search ..... 347/101, 347/104; 400/656, 648
See application file for complete search history.

(56) References Cited

U.S. PATENT DOCUMENTS 6,644,801 B2 * 11/2003 Matsui et al. ..... 347/104
6,719,393 B2 * 4/2004 Uchida ..... 347/16
6,840,617 B2 * 1/2005 Crosby et al. ..... 347/104

(Continued)

FOREIGN PATENT DOCUMENTS

JP 2000-351205 12/2000

(Continued)

*Primary Examiner*—Matthew Luu
*Assistant Examiner*—Joshua M Dubnow
(74) *Attorney, Agent, or Firm*—Sonnenschein Nath & Rosenthal LLP

(57) ABSTRACT

A platen plate for supporting an ejection object for liquid droplets ejected from each nozzle on the bottom surface of a liquid ejection head can secure the flatness of the ejection object so as to appropriately eject ink as well as can prevent the contamination of the bottom surface of the ejection object. The platen plate is provided with a plurality of ribs raised from its bottom surface so as to extend in a conveying direction of a recording sheet and arranged at predetermined intervals in a width wise direction of the recording sheet, and out of a region where ink droplets ejected from the each nozzle are landed, the bottom surface of the recording sheet is supported with top faces of the ribs so as to define a distance between the recording sheet and the ink ejection surface, and within the region where ink droplets ejected from the each nozzle are landed, the rib top faces are formed to have a height, or the ribs themselves do not exist, so that the rib top faces are not brought into contact with the bottom surface of the recording sheet.

2 Claims, 13 Drawing Sheets

U.S. PATENT DOCUMENTS

| | | | | |
|---|---|---|---|---|
| 6,899,421 | B2 * | 5/2005 | Taguchi et al. | 347/104 |
| 6,908,168 | B2 * | 6/2005 | Kawaguchi | 347/12 |
| 2002/0047885 | A1 * | 4/2002 | Miyawaki et al. | 347/104 |
| 2002/0089564 | A1 * | 7/2002 | Ohashi | 347/41 |
| 2002/0135653 | A1 * | 9/2002 | Otsuki | 347/104 |

FOREIGN PATENT DOCUMENTS

| | | | |
|---|---|---|---|
| JP | 2001-30481 | | 2/2001 |
| JP | 2001-71480 | | 3/2001 |
| JP | 2001071480 | * | 3/2001 |
| JP | 2002-192713 | | 7/2002 |
| JP | 2002-264319 | | 9/2002 |
| JP | 2003-96658 | | 4/2003 |
| JP | 02006056047 | * | 3/2006 |
| JP | 02006188070 | * | 3/2006 |

* cited by examiner

PLATEN PLATE AND LIQUID DISCHARGING DEVICE

TECHNICAL FIELD

The present invention relates to a platen plate arranged at a position opposing a liquid ejection surface on the bottom of a liquid ejection head for supporting an ejection object for receiving a liquid droplet ejected from each nozzle on the liquid ejection surface, and a liquid ejection apparatus using the platen plate.

BACKGROUND ART

Recording apparatuses, such as an inkjet printer, have been known as a liquid ejection apparatus in that liquid in a liquid chamber of a liquid ejection head is heated and ejected through a liquid ejection nozzle. In such an inkjet printer, ink droplets are ejected from respective nozzles arranged on an ink ejection surface on the bottom surface of a print head so as to form printed images, and a platen plate is arranged at a position opposing the ink ejection surface of the print head.

The platen plate defines the distance between the ink ejection surface and a recording sheet as an ejection object, which is conveyed by conveying means built in the inkjet printer, by supporting the recording sheet from the backside. The plate-like platen plate has a plurality of ribs (platen ribs) formed on the top surface at predetermined intervals in the width wise direction of the recording sheet so as to extend in the conveying direction of the recording sheet. In the inkjet printer having such a platen plate, the recording sheet supported with top faces of the ribs has been conveyed by the conveying means and printed by ejecting ink on the surface of the recording sheet from each nozzle.

However, in such an inkjet printer, when vertical and horizontal white spaces on a recording sheet are eliminated so as to perform so-called rimless printing or when a recording sheet smaller in size than that in established-size is used in mistake, excessive ink droplets are ejected across the periphery of the recording sheet, ink may attach the ribs of the platen plate so as to contaminate the plate, so that the ink attached on the platen ribs may contaminate the bottom surface of the recording sheet. Thus, for avoiding the contamination of the recording sheet bottom surface, it is necessary for the ribs of the platen plate not to have ink droplets attached thereon, so that a platen plate of such kind having a recess (ink receiver) formed on a region where ink droplets are attached for receiving ejected ink droplets has been known (see Japanese Unexamined Patent Application Publication No. 2000-118058 (P 3 to 4, FIGS. 2 and 3, or Japanese Unexamined Patent Application Publication No. 2002-86821 (P 4 to 5, FIGS. 1 and 2), for example).

However, techniques disclosed in Japanese Unexamined Patent Application Publication No. 2000-118058 and Japanese Unexamined Patent Application Publication No. 2002-86821 are applied to an inkjet printer having a so-called serial type print head, and they have been difficult to be applied to a printer having a line-type print head in that a number of nozzle rows are arranged over the entire width of a recording sheet. That is, in the printer having the serial type print head, ink droplets are ejected from each nozzle while the recording sheet is reciprocating in the width wise direction so as to form images on one region in a state that the recording sheet is stopped, and then, the recording sheet is conveyed in the conveying direction so as to form images on the next region after being stopped, so that the flatness of the recording sheet arranged under the ink ejection surface is no problem.

Whereas, in the printer having the line-type print head, while the recording sheet is conveyed, ink droplets are ejected from respective nozzles arranged in the width wise direction of the recording sheet so as to form images, so that in a state that the recording sheet conveyed under the ink ejection surface is not flatly supported, images may not be appropriately formed. In particular, in the case of a print head having ejection direction deflecting means for controlling to change the ejection direction of the ink droplets from each nozzle, the landing position of the ink droplet is deflected in the width wise direction of the recording sheet, so that the flatness of the recording sheet conveyed under the ink ejection surface needs to be secured.

DISCLOSURE OF INVENTION

Accordingly, the present invention has been made so as to solve such problems, and it is an object thereof to provide a platen plate, by which the flatness of an ejection object conveyed under a liquid ejection surface is secured so as to appropriately eject liquid and to prevent the bottom surface of the ejection object from being contaminated, and a liquid ejection apparatus using the platen plate.

In order to achieve the above-mentioned objects, according to the present invention, out of a region where liquid droplets ejected from the each nozzle are landed, with a plurality of ribs raised from its bottom surface so as to extend in a conveying direction of the ejection object and arranged at predetermined intervals in a width wise direction of the ejection object, the bottom surface of the ejection object is supported so as to define a distance between the ejection object and the liquid ejection surface, and within the region where liquid droplets ejected from the each nozzle are landed, rib top faces are not brought into contact with the bottom surface of the ejection object.

Accordingly, with the plurality of ribs arranged at predetermined intervals in a width wise direction of the platen plate, the flatness of the ejection object conveyed underneath the liquid ejection surface of the liquid ejection head is secured so as to appropriately eject liquid while the rib top faces are not contaminated with ink ejected across the peripheral end of the ejection object so as to prevent the contamination of the backside of the ejection object.

Also, the ribs may be provided with inclined surfaces or curved surfaces formed at an upstream end in a conveying direction of the ejection object, so that the leading end of the ejection object is introduced to the rib top faces. Hence, even when liquid ejected across the peripheral end of the ejection object is ejected on the leading end of the ejection object so that the leading end of the ejection object is deflected to fall downward, the ejection object is introduced to the rib top faces so as to prevent sheet jamming and to secure sheet flatness.

Furthermore, in rows adjacent to each other of the plurality of ribs, the rib top faces positioned on an upstream side, or a downstream side, of a conveying direction of the ejection object may be displaced from the other rib top faces, so that the ejection object is supported with the plurality of ribs so as to secure the flatness in the width wise direction. Therefore, the ejection object is prevented from deflecting so as to increase the distance to the liquid ejection surface, appropriately ejecting liquid on the ejection object. Since the distance between rib rows is secured, a metallic mold used for forming the platen plate is reinforced.

Furthermore, between the plurality of ribs, within the region where liquid droplets ejected from the each nozzle are landed, a liquid absorbing material may be provided for absorbing the liquid droplets, so that the splash of the liquid droplets swiftly ejected from the each nozzle can be reduced, preventing the contamination of the bottom surface of the ejection object. By absorbing the ejected liquid droplets with the liquid absorbing material, even when liquid is stored to some extent, the liquid spilling due to vibration can be prevented.

The ribs may be formed so as to continuously extend in a width wise direction of the ejection object, so that the perfect flatness of the ejection object in the width wise direction can be secured so as to appropriately eject ink on the surface of the ejection object.

By constructing the platen plate mounted on a liquid ejection apparatus and arranged at a position opposing the liquid ejection surface on the bottom surface of the liquid ejection head in the same way as that for the platen plate described above, out of a region where liquid droplets ejected from the each nozzle are landed, with a plurality of ribs raised from its bottom surface so as to extend in a conveying direction of the ejection object and arranged at predetermined intervals in a width wise direction of the ejection object, the bottom surface of the ejection object is supported so as to define a distance between the ejection object and the liquid ejection surface, and within the region where liquid droplets ejected from the each nozzle are landed, rib top faces are not brought into contact with the bottom surface of the ejection object.

Accordingly, with the plurality of ribs arranged at predetermined intervals in a width wise direction of the platen plate, the flatness of the ejection object conveyed underneath the liquid ejection surface of the liquid ejection head is secured so as to appropriately eject liquid while the rib top faces are not contaminated with ink ejected across the peripheral end of the ejection object so as to prevent the contamination of the backside of the ejection object.

Also, the leading end of the ejection object is introduced to the rib top faces, and hence even when liquid ejected across the peripheral end of the ejection object is ejected on the leading end of the ejection object so that the leading end of the ejection object is deflected to fall downward, the ejection object is introduced to the rib top faces so as to prevent sheet jamming and to secure sheet flatness.

Furthermore, since the ejection object is supported with the plurality of ribs so as to secure the flatness in the width wise direction, the ejection object is prevented from deflecting so as to increase the distance to the liquid ejection surface, appropriately ejecting liquid on the ejection object. Since the distance between rib rows is secured, a metallic mold used for forming the platen plate is reinforced.

Furthermore, the splash of the liquid droplets swiftly ejected from the each nozzle can be reduced, preventing the contamination of the bottom surface of the ejection object. By absorbing the ejected liquid droplets with the liquid absorbing material, even when liquid is stored to some extent, the liquid spilling due to vibration can be prevented.

Then, the perfect flatness of the ejection object in the width wise direction can be secured so as to appropriately eject ink on the surface of the ejection object.

The liquid ejection apparatus may further includes conveying means having a conveying belt arranged along a predetermined route for conveying the ejection object from a supply side to the liquid ejection head of the ejection object to a discharge side thereof, and within a region where predetermined liquid is ejected from the liquid ejection head, the conveying belt of the conveying means is located in the rear of the platen plate relative to the liquid ejection head, so that the conveying belt conveying the ejection object within the region where predetermined liquid is ejected from the liquid ejection head can be prevented from being contaminated by the predetermined liquid is ejected from the liquid ejection head with a simple structure.

Furthermore, by providing route changing means arranged at a position where the conveying belt is located in the rear of the platen plate for changing the route of the conveying belt, the route of the conveying belt can be easily changed by the route changing means.

BRIEF DESCRIPTION OF THE DRAWINGS

FIG. 1A is a plan view thereof; FIG. 1B is a sectional view at the line A-A of FIG. 1A; and FIG. 1C is a sectional view at the line B-B of FIG. 1A.

BEST MODE FOR CARRYING OUT THE INVENTION

Embodiments of the present invention will be described below in detail with reference to the attached drawings.

Figure 1A:
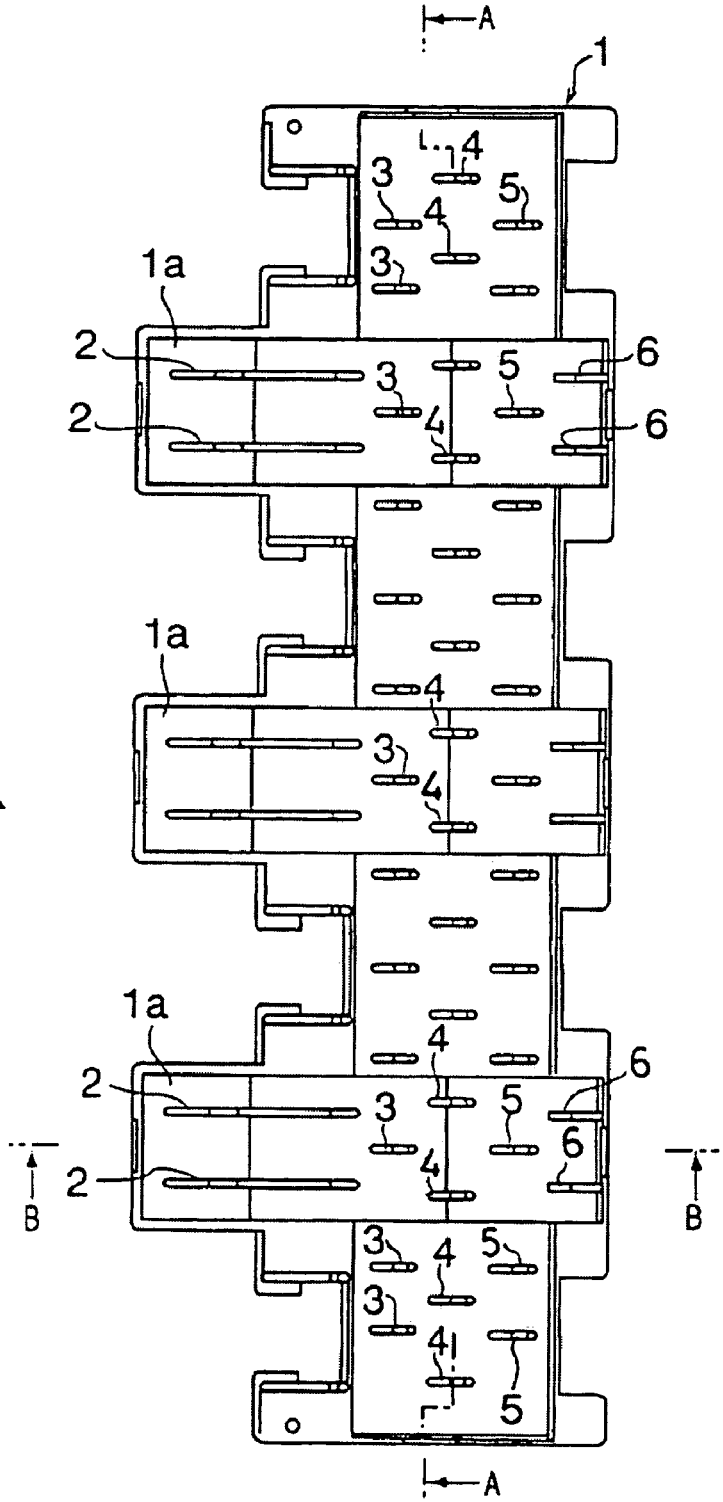
FIGS. 1A to 1C are explanatory drawings of an embodiment of a platen plate according to the present invention.
Figure 1B:
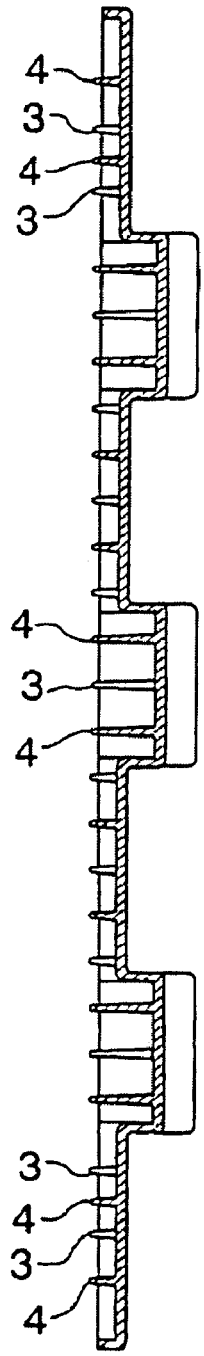
Figure 1C:
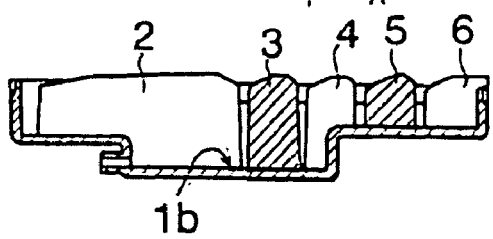

FIGS. 1A to 1C are explanatory drawings of the embodiment of a platen plate according to the present invention; FIG. 1A is a plan view thereof; FIG. 1B is a sectional view at the line A-A of FIG. 1A; and FIG. 1C is a sectional view at the line B-B of FIG. 1A. The platen plate 1, as shown in FIG. 2, is arranged at a position opposing an ink ejection surface 22 on the bottom surface of a print head 20 (below mentioned) so as to support a recording sheet 51, on which ink droplets ejected from respective ejection nozzles 23 (23*k*, 23*c*, 23*m*, and 23*v*) are landed from the backside, also serving as an ink reservoir for receiving excessive ink droplets ejected across edges of the recording sheet 51 so as to be stored.

The platen plate 1 entirely made of an ABS resin, as shown in FIG. 1A, is formed in a slender box shape having raised pieces formed along the periphery in a width corresponding to the width wise direction of the ink ejection surface 22 of the print head 20. The platen plate 1 is also provided with extensions 1*a* arranged on the upstream side in the conveying direction of the recording sheet 51 so as to ensure the conveying stability of the recording sheet 51 as well as to sufficiently store ejected ink droplets. Furthermore, as shown in FIG. 1C, the platen plate 1 is provided with ribs 2 to 6 raised from a bottom surface 1*b* so as to extend in the conveying direction of the recording sheet 51. A plurality of the ribs 2 to 6, as shown in FIG. 1A, is arranged at predetermined in the width wise direction of the platen plate 1. Furthermore, as shown in FIG. 1B, the platen plate 1 has a bottom end which has a crenellated shape in cross section.

Figure 2:
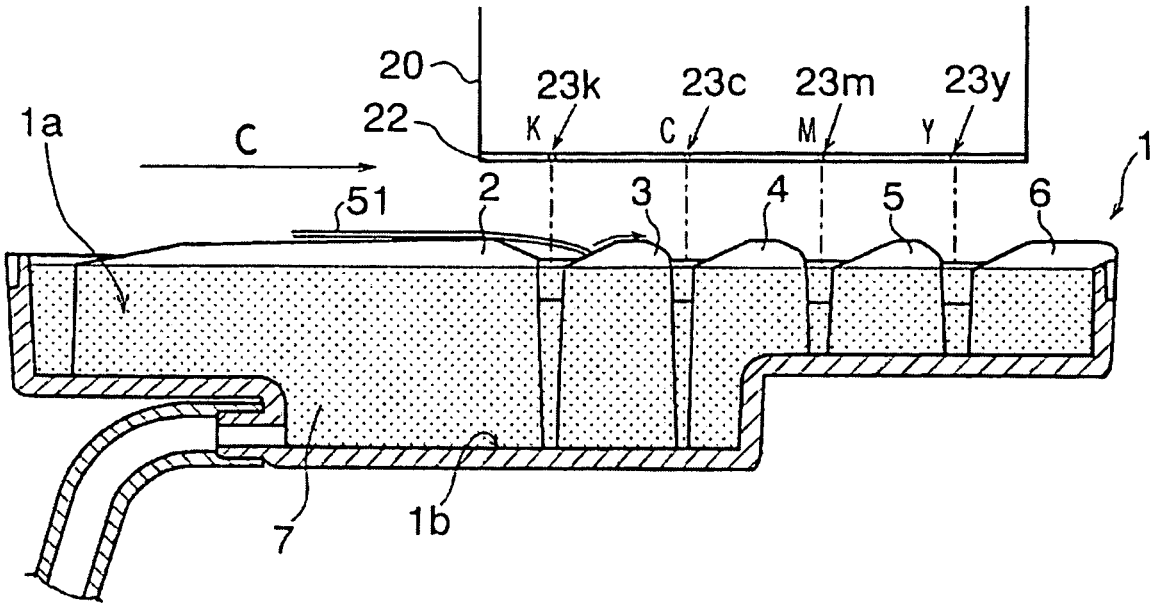
FIG. 2 is a sectional view showing a state of a recoding sheet conveyed over rib top faces arranged on the platen plate.
Figure 3:
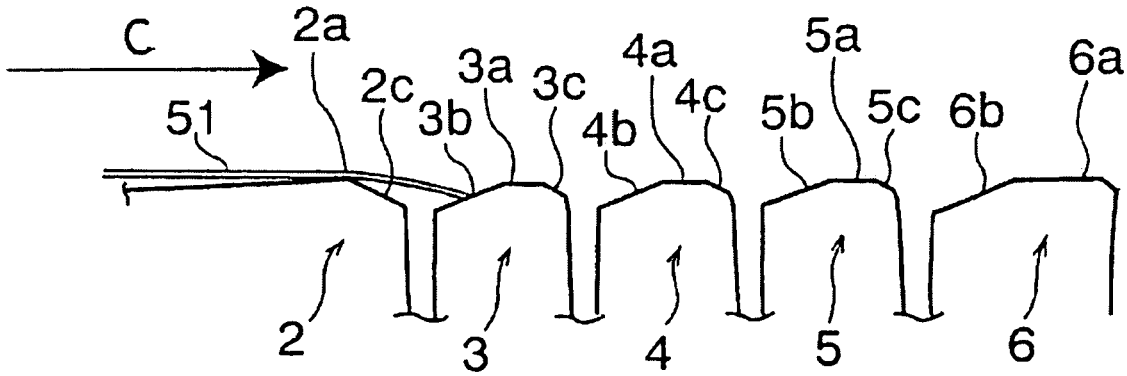
FIG. 3 is a sectional view of the shape of ribs of the platen plate.

The ribs 2 to 6, as shown in FIGS. 2 and 3, are for supporting the backside of the recording sheet 51, and first to fifth ribs 2 to 6 are formed from the upstream to the downstream of the conveying direction of the recording sheet 51 in that order. The rib top faces 2*a* to 6*a* of the ribs 2 to 6 have substantially the same height. The ribs 2 to 6 are formed to define the distance between the recording sheet 51 and the ink ejection surface 22 by supporting the backside of the recording sheet 51 with the rib top faces 2*a* to 6*a* outside the region where ink droplets ejected from the respective ink ejection nozzles 23 of the ink ejection surface 22 are landed while in the region where the ink droplets are landed, the ribs are eliminated.

Thereby, with the plurality of the ribs 2 to 6 formed on the platen plate 1 as mentioned above, the backside of the recording sheet 51 is supported so as to define the distance between the recording sheet 51 and the ink ejection surface 22 outside the region where ink droplets ejected from the respective ink ejection nozzles 23 of the ink ejection surface 22 are landed. In the region where the ink droplets ejected from the respective ink ejection nozzles 23 of the ink ejection surface 22 are landed, the ribs 2 to 6 themselves do not exist so that the rib top faces are not brought into contact with the backside of the recording sheet 51. Accordingly, with the plurality of the ribs 2 to 6 arranged at predetermined intervals in the width wise direction of the platen plate 1, the flatness of the recording sheet 51 conveyed under the ink ejection surface 22 of the print head 20 is assured so as to appropriately eject ink on the surface of the recording sheet 51. Also, the top faces of the ribs 2 to 6 are not contaminated with ink ejected across the peripheral end of the recording sheet 51 so as to prevent the contamination of the backside of the recording sheet 51.

In the above description, in the region of the platen plate 1 where the ink droplets from the respective ink ejection nozzles 23 are landed, the ribs themselves are eliminated; however, the present invention is not limited to this, so that within the region, ribs (not shown) may also be provided so as to have a height in that rib top faces are not brought into contact with the backside of the recording sheet 51.

As shown in FIG. 3, the respective ribs 2 to 6 are provided with an inclined surface formed at the end in the upstream side of the conveying direction of the recording sheet 51 for introducing the leading edge of the recording sheet 51 conveyed from the upstream side to the rib top face. For example, the second rib 3 is provided with the inclined surface 3*b* largely chamfered at the end in the upstream side, so as to guide the leading edge of the recording sheet 51 conveyed in arrow direction C. Thereby, the leading end of the recording sheet 51 conveyed with its end downward flagging is introduced to the top face 3*a* with the inclined surface 3*b* of the second rib 3 so as to prevent jamming. If ink droplets are ejected on the leading end of the recording sheet 51 especially when rimless printing is performed, for example, the leading end of the recording sheet 51 is deflected and liable to fall downward; however, the inclined surface 3*b* is formed on the upstream end of the second rib 3, so that the leading end of the recording sheet 51 is guided on the top face 3*a* with the inclined surface 3*b* of the second rib 3 so as to prevent the jamming. The third to fifth ribs 4 to 6 are also formed in the same shape.

Thus, when the recording sheet 51 passing through the top face 3*a* of the second rib 3 is further conveyed in arrow direction C, even if the recording sheet 51 with its end downward flagging proceeds between the second rib 3 and the third rib 4, the recording sheet 51 can be guided to the rib top face 4*a* without being caught on the upstream end of the third rib 4 so as to sequentially convey the recording sheet 51 to the following fourth and fifth ribs 5 and 6. In such a manner, the recording sheet 51 can be conveyed by supporting it with the rib faces 2*a* to 6*a* so as to have a predetermined distance to the ink ejection surface 22.

Also, as shown in FIG. 3, the first to fourth ribs 2 to 5 are also provided with inclined surfaces 2*c* to 5*c*, respectively, in the same way as mentioned above. Thereby, although not shown, even when the recording sheet 51 is conveyed in a direction opposite to arrow C direction, the leading end in the conveying direction cannot be caught on the downstream end of the respective ribs 2 to 6. Thus, the jamming when the recording sheet 51 is conveyed in the direction opposite to arrow C direction can be prevented. In the above-description, the respective ribs 2 to 6 are provided with an inclined surface formed at the upstream end; however, the present invention is not limited to this, so that any shape may be provided as long as it prevents the jamming of the conveyed recording sheet 51. Other specific shapes will be described later with reference to FIGS. 14 to 16.

Figure 4:
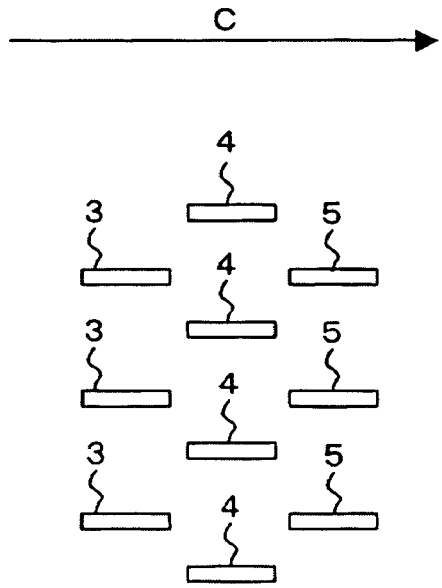
FIG. 4 is a plan view showing the arrangement of the ribs of the platen plate.

Furthermore, as shown in FIG. 1A, in rows adjacent to each other of a plurality of the ribs 2 to 6 of the platen plate 1, the rib top faces positioned on the upstream or downstream side of the conveying direction of the recording sheet 51 are displaced from the other rib top faces. Specifically, as show in FIG. 4, the row of the third ribs 4 arranged at predetermined intervals in the width wise direction is arranged not to overlap with the row of the second ribs 3 and the fourth ribs 5, which are arranged on the upstream or downstream side, in the conveying direction of the recording sheet 51 shown by arrow C. Thereby, the recording sheet 51 is supported with the ribs 2 to 6 arranged as mentioned above, so that its flatness in the width wise direction is assured. Hence, the recording sheet 51 is prevented from deflecting so as to expand the distance to the ink ejection surface 22, so that ink can be appropriately ejected on the surface of the recording sheet 51. When the ribs 2 to 6 of the platen plate 1 are arranged in the same way as mentioned above, the distance between the rows of the ribs can be secured, so that there is also an advantage that a metallic mold used for forming the platen plate 1 is reinforced.

In the above arrangement of the ribs 2 to 6 is not limited to that shown in FIGS. 1A to 1C, so that any arrangement may be provided as long as it can secure the flatness of the recording sheet 51 in the width wise direction. Other specific arrangements will be described later with reference to FIGS. 17 and 18.

As shown in FIG. 2, the platen plate 1 is provided with an ink absorbing material 7 arranged within a region where ink droplets ejected from the respective ink ejection nozzles 23 are landed. The ink absorbing material 7 is made of a sponge for absorbing the ink droplets ejected from the respective ink ejection nozzles 23 so as to absorb the ink droplets ejected across the peripheral end of the recording sheet 51 when rimless printing is performed. Thereby, the splash of the ink droplets swiftly ejected from the respective ink ejection nozzles 23 and bounced can be reduced, preventing the contamination of the bottom surface of the recording sheet 51. By providing the ink absorbing material 7, even when ink is stored to some extent, the ink spilling due to vibration can be prevented.

Since the platen plate 1 is replaceable for easy maintenance, it can be simply cleaned by dismounting it when being contaminated with ink.

Figure 5:
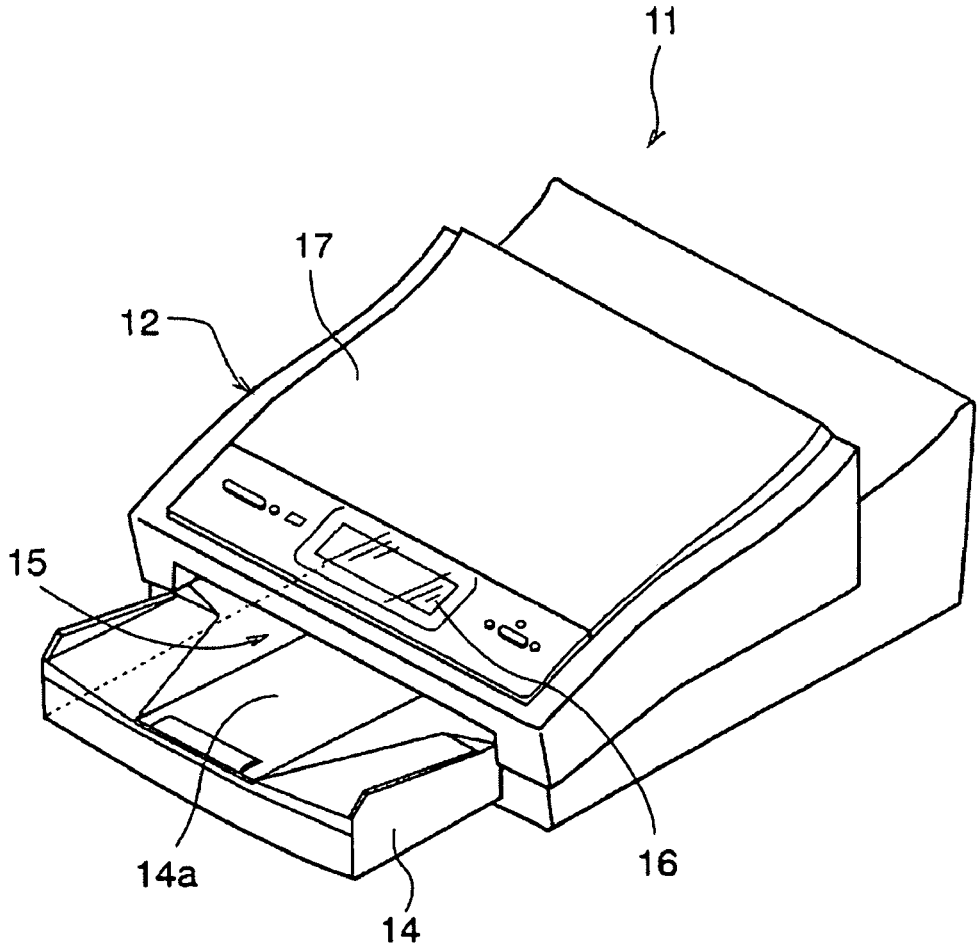
FIG. 5 is a schematic perspective view of an embodiment of an inkjet printer as a liquid ejection apparatus according to the present invention.

FIG. 5 is a perspective view of an embodiment of an inkjet printer 11 as an example of the liquid ejection apparatus according to the present invention. The inkjet printer 11 includes a printer body 12, a head cartridge 13 (see FIG. 6), and a recording sheet tray 14 for forming images by ejecting ink droplets at a predetermined position on a recording sheet.

The printer body 12 includes a conveying mechanism for conveying a recording sheet stored in the recording sheet tray 14 and an electric circuit for appropriately printing images on the recording sheet, which are accommodated inside, and in a tray insertion inlet 15 arranged in the lower front of the printer body 12, the recording sheet tray 14 is detachably attached. The tray insertion inlet 15 also serves as a sheet outlet of the recording sheet so that the recording sheet printed inside the printer body 12 is discharged on a sheet receiver 14*a* on the surface of the recording sheet tray 14. In the upper front of the printer body 12, a display panel (display) 16 is provided for displaying the entire operational state of the inkjet printer 11.

Figure 6:
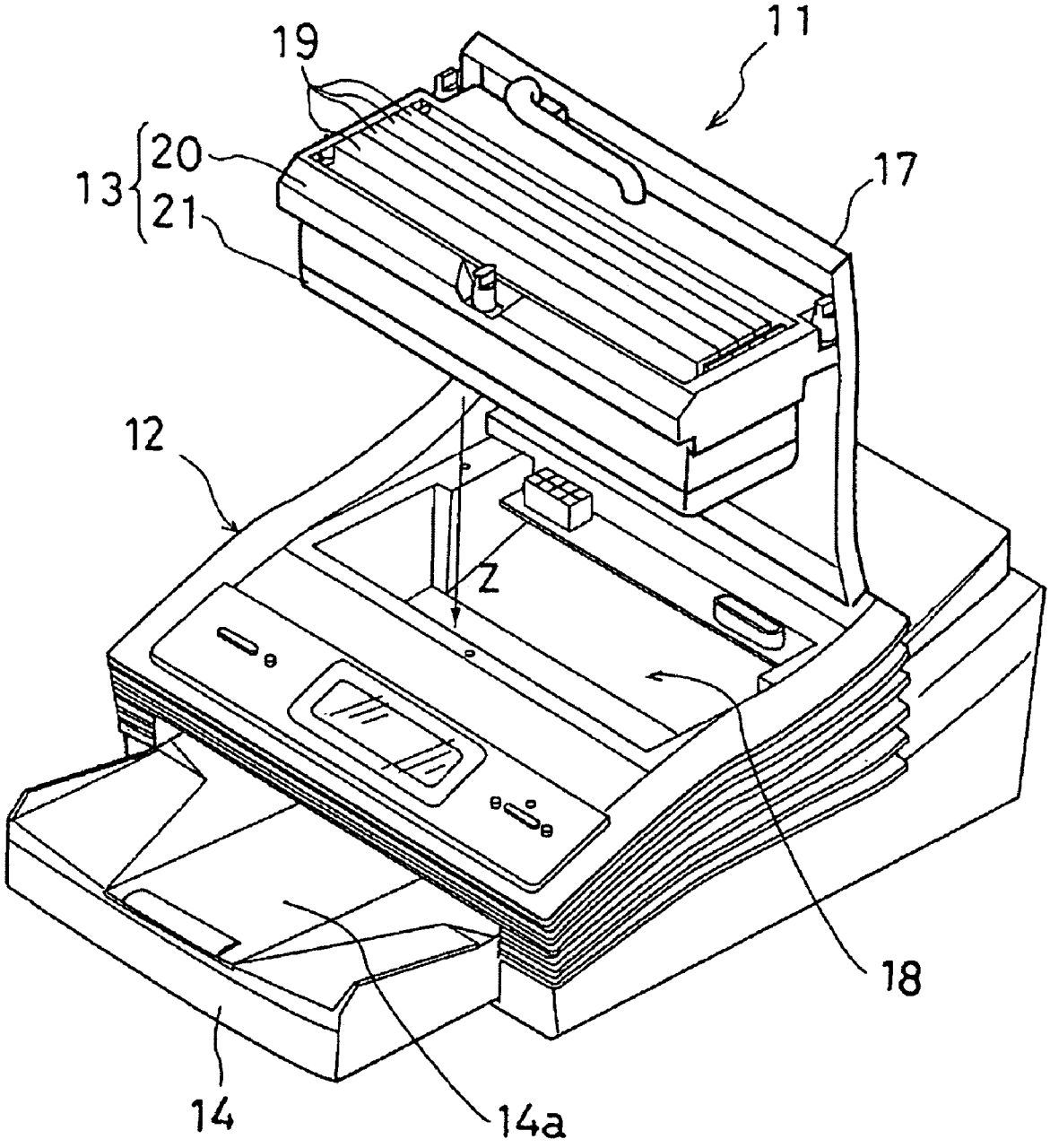
FIG. 6 is a perspective view showing a state of a head cartridge accommodated into an accommodation section by opening an upper lid arranged in the inkjet printer.

On the top surface of the printer body 12, an upper lid 17 is openably attached, and as shown in FIG. 6 when the upper lid 17 is opened, an accommodation section 18 is provided on the upper surface of the printer body 12 for accommodating the head cartridge 13. The accommodation section 18 of the printer body 12 accommodates the head cartridge 13 hung in arrow Z direction so as to be detachably held therein. The head cartridge 13 includes the print head 20 having four-color ink tank 19 of yellow Y, magenta M, cyan C, and black K and a head cap 21 mounted on the bottom surface of the print head 20. The print head 20 is called as a full-line type and has ink ejection nozzle rows arranged on the bottom surface of its ink ejection surface corresponding to the entire width of a recording sheet (A4 size in Japanese Standard, for example) so as to eject ink on the recording sheet in a state fixed within the accommodation section 18 for forming images with a required width.

Figure 7:
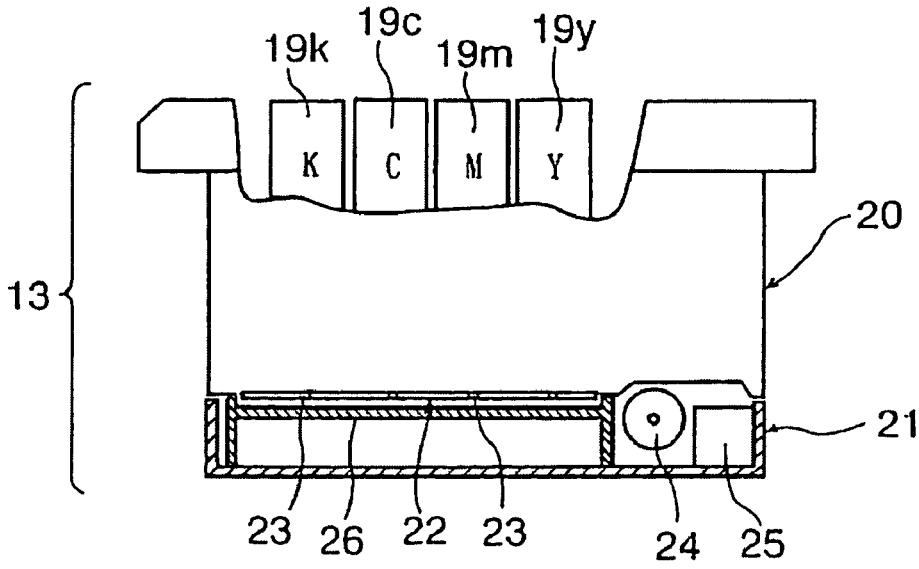
FIG. 7 is a partially sectional side view of the head cartridge in the liquid ejection apparatus.

FIG. 7 is a partially sectional side view of the head cartridge 13. The ink tank 19 is a liquid container for storing ink (predetermined liquid), and is detachably composed of four tanks 19*y*, 19*m*, 19*c*, and 19*k* corresponding to four-color inks Y, M, C, and K. The print head 20 is a liquid ejection head for ejecting inks by receiving inks from the ink tanks 19*y*, 19*m*, 19*c*, and 19*k*, and has rows of the ink ejection nozzles (liquid ejection nozzles) 23 arranged on the ink ejection surface 22 of its bottom surface.

On the bottom surface of the print head 20, the head cap 21 is mounted detachably and movably in relation to the print head 20. The head cap 21 is formed in a slender box shape with pieces raised from its four sides for protecting the ink ejection surface 22 of the print head 20. The head cap 21 includes a cleaning roller (cleaning member) 24 for wiping thicken and attached ink sludge while moving through the ink ejection surface 22 and a waste liquid receiver 25 for receiving ink ejected in vain, which are arranged inside. The cleaning roller 24 is made of a member having elasticity and hygroscopic properties such as a sponge. The waste liquid receiver 25 is made of a member having hygroscopic properties such as a sponge. Reference numeral 26 denotes a nozzle sealing member arranged at a position close to the ink ejection surface 22 of the print head 20 within the head cap 21. During normal non-printing, the ink ejection nozzles 23 are protected with the head cap 21 so that ink does not dry up.

Figure 8:
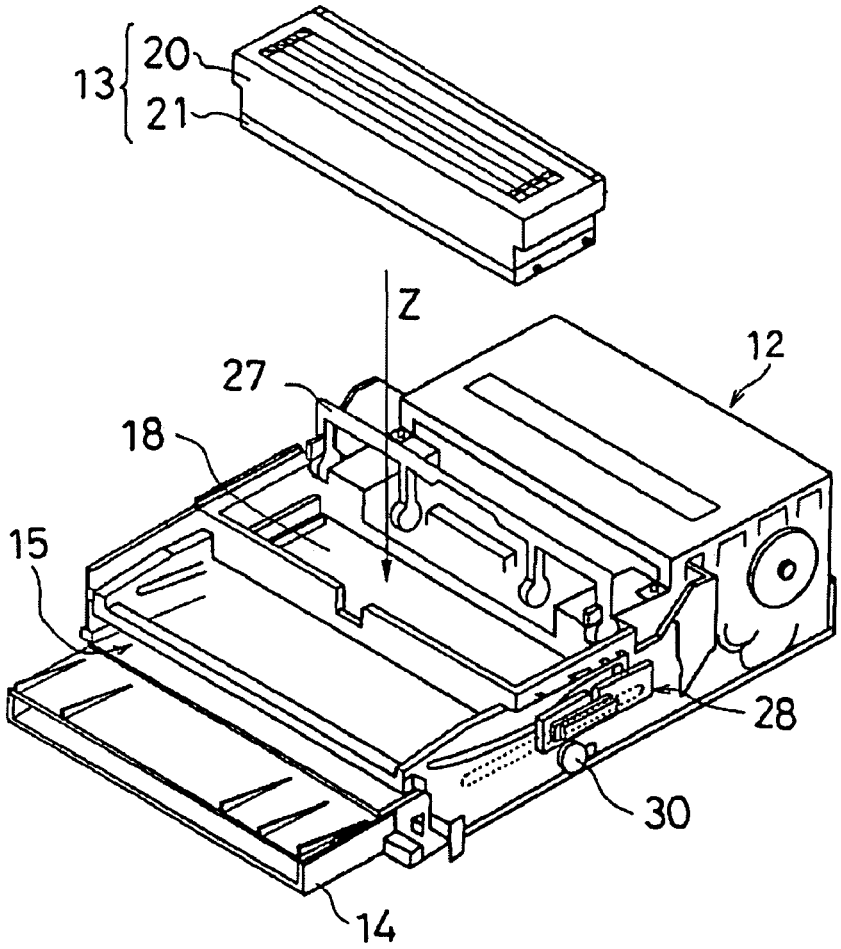
FIG. 8 is an explanatory view showing the internal structure of the printer body shown in FIG. 5 by removing an outer cover.
Figure 9:
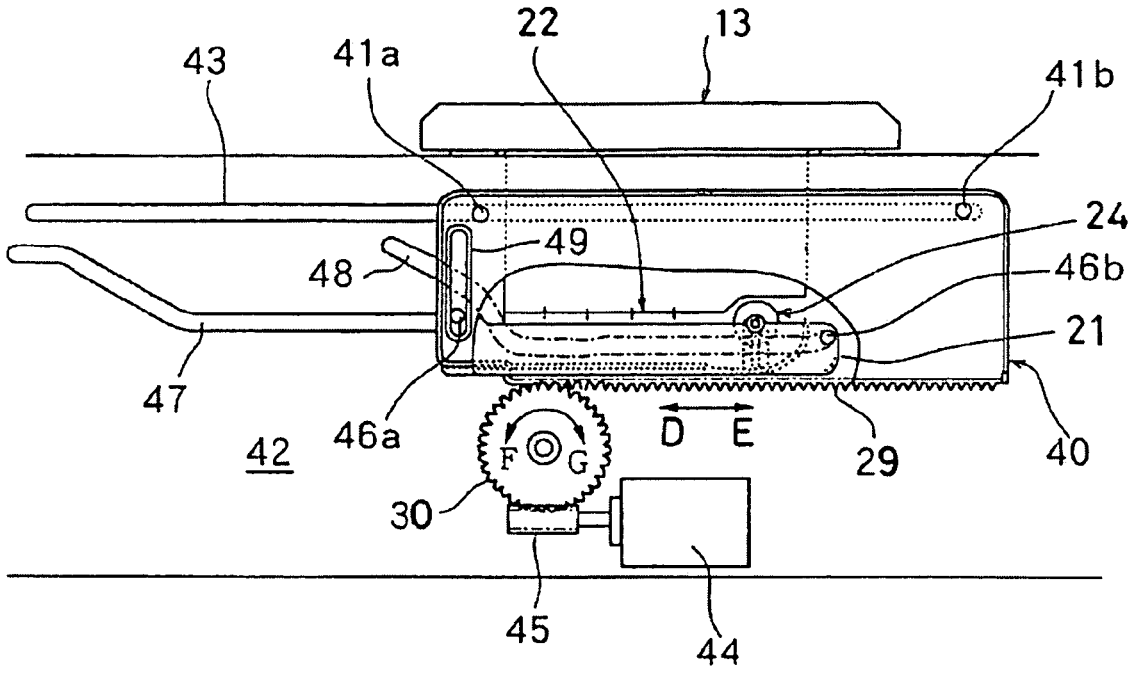
FIG. 9 is an explanatory view showing a head cap open/close mechanism shown in FIG. 8.

Next, the movement structure of the head cap 21 will be described with reference to FIGS. 8 and 9. FIG. 8 is an explanatory view showing the internal structure of the printer body 12 shown in FIG. 6 by removing an outer cover; FIG. 9 is an explanatory view showing a head cap open/close mechanism. Referring to FIG. 8, after the head cartridge 13 is hung down in arrow Z direction to the printer body 12 so as to accommodate it within the accommodation section 18, the head cap open/close mechanism 27 is reclined forward at about 90° so as to fix the head cartridge 13 to the printer body 12. At this time, the head cap 21 is brought into engagement with a head cap open/close mechanism 28 shown in FIG. 8.

FIG. 9 is a side view showing the head cap open/close mechanism 28 in detail. First, the head cap 21 shown in FIG. 7 and having the cleaning roller 24 attached thereto, as shown in FIG. 9, is supported to a movement rack plate 40 having a straight rack 29 formed its bottom side. In the movement rack plate 40 for moving the head cap 21 in arrows D and E directions, two guide pins 41*a* and 41*b* provided at upper both ends of an inner side plate of the movement rack plate 40 are brought into engagement with a straight movement guide groove 43 formed on one external side plate 42 of the printer body 12, and the rack 29 formed in the bottom side of the movement rack plate 40 is mated with a pinion 30 rotated by a worm gear 45 attached on a rotational shaft of a movement motor 44 attached to the one external side plate 42.

One external side surface of the head cap 21 is provided with two front/rear cap guide pins 46*a* and 46*b* protruding toward the movement rack plate 40. In an intermediate portion of the one external side plate 42 of the printer body 12, two cap guide grooves 47 and 48 curved in a predetermined shape for forming a movement trajectory of the head cap 21. Then, the two front/rear cap guide pins 46*a* and 46*b* of the head cap 21 are brought into engagement with the cap guide grooves 47 and 48 of the one external side plate 42 of the printer body 12, respectively. Furthermore, only the front guide pin 46*a* is brought into engagement with a guide groove 49 longitudinally formed at the front end of the movement rack plate 40.

With such a mechanism, the pinion 30 is rotated via the worm gear 45 by the driving of the movement motor 44 in arrows F and G directions so that the movement rack plate 40 is moved in arrows D and E directions by the rack 29 mated with the pinion 30. Since the front guide pin 46*a* is brought into engagement with the guide groove 49 at the front end of the movement rack plate 40 at this time, the head cap 21 is moved in arrows D and E directions together with the movement rack plate 40. The movement trajectory of the head cap 21 at that time is defined by the shapes of the cap guide grooves 47 and 48 brought into engagement with the two front/rear cap guide pins 46*a* and 46*b*, respectively.

Figure 10A:
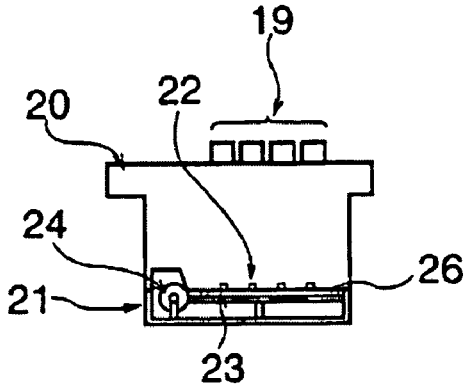
FIGS. 10A to 10E are explanatory views showing the cleaning operation when a head cap is moved by the head cap open/close mechanism.

Next, the cleaning operation when the head cap 21 is moved by the head cap open/close mechanism 28 structured as mentioned above will be described with reference to FIGS. 10A to 10E. First, FIG. 10A shows a state that at initial stage, the head cap 21 is closed to the ink ejection surface 22 of the print head 20, and the four-color ink ejection nozzles 23 of Y, M, C, and K are protected with the nozzle sealing member 26.

Figure 10B:
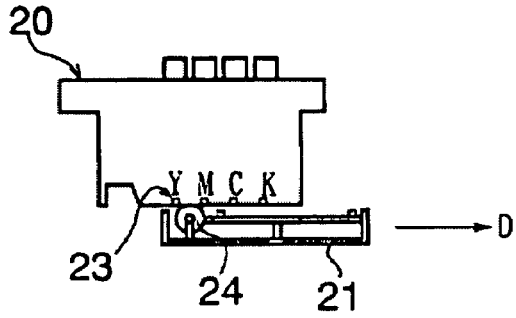

If an open trigger signal is input to the printer body 12 from this state when the printer is started, printing is started, or an operator instructs, the movement motor 44 shown in FIG. 9 is rotated so that the head cap 21 is started to move in arrow D direction as shown in FIG. 10B. At this time, the cleaning roller 24 made of a sponge, for example, is sequentially rotated while rubbing the ink ejection surface 22 following the movement of the head cap 21. During the rotating, ink sludge thicken and attached to the four-color ink ejection nozzles 23 of Y, M, C, and K is wiped with the cleaning roller 24.

Figure 10C:
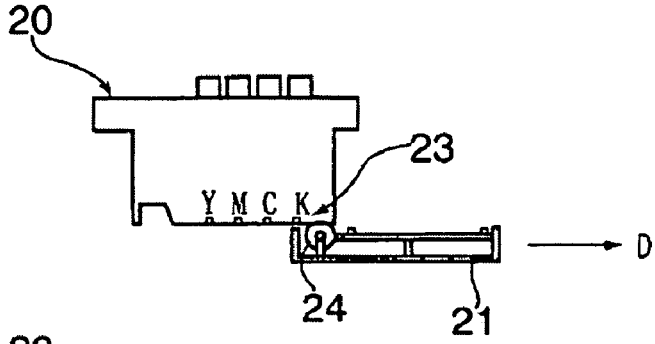

Furthermore, when it is detected by an optical or mechanical sensor (not shown) that the waste liquid receiver 25 (see FIG. 7) made of a sponge, for example, arrives directly underneath the ink ejection nozzles 23 after the ink sludge is wiped with the cleaning roller 24, blank ink ejection is performed for preventing clogging of the ink ejection nozzles 23. FIG. 10B shows a stat that blank ink is ejected on the waste liquid receiver 25, which arrives directly underneath the Y-color ink ejection nozzles 23 after the ink sludge of the Y-color ink ejection nozzles 23 is wiped with the cleaning roller 24. FIG. 10C shows a stat that blank ink is ejected on the waste liquid receiver 25, which arrives directly underneath the K-color ink ejection nozzles 23 after the ink sludge of the K-color ink ejection nozzles 23 is wiped with the cleaning roller 24.

Figure 10D:
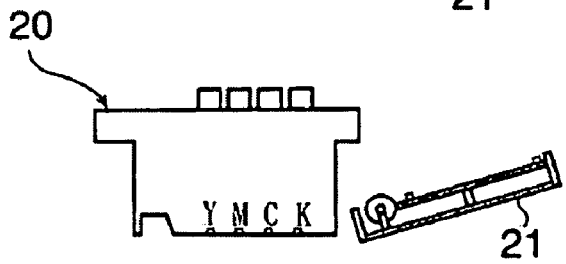

In a state that the wiping and the blank ink ejection of all the four-color ink ejection nozzles 23 of Y, M, C, and K are finished in such a manner, as shown in FIG. 10D, the head cap 21 moves in arrow D direction at most so as to be anchored at a retracted position. In this state, the printer body 12 and the head cartridge 13 can print images.

Figure 10E:
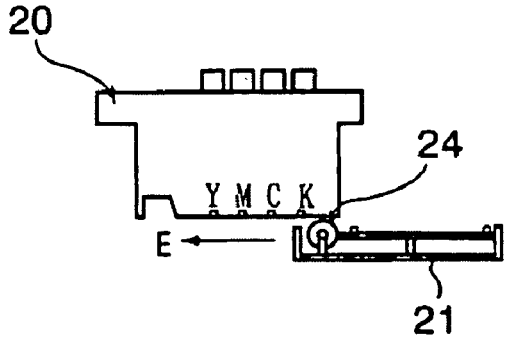

Upon completion of predetermined printing, a close trigger signal is input to the printer body 12 and the movement motor 44 shown in FIG. 9 is reversed, so that as shown in FIG. 10E, the head cap 21 moves in arrow E direction from the retracted position so as to be returned to the original position along the same trajectory as that of the approach route. In this homeward route, the cleaning roller 24 does neither the wiping nor the blank ink ejection. This is for elongating the life time of the cleaning roller 24 and delaying part replacement. When the head cap 21 is moved in arrow E direction at most, the system is returned to the initial stage shown in FIG. 10A.

Figure 11:
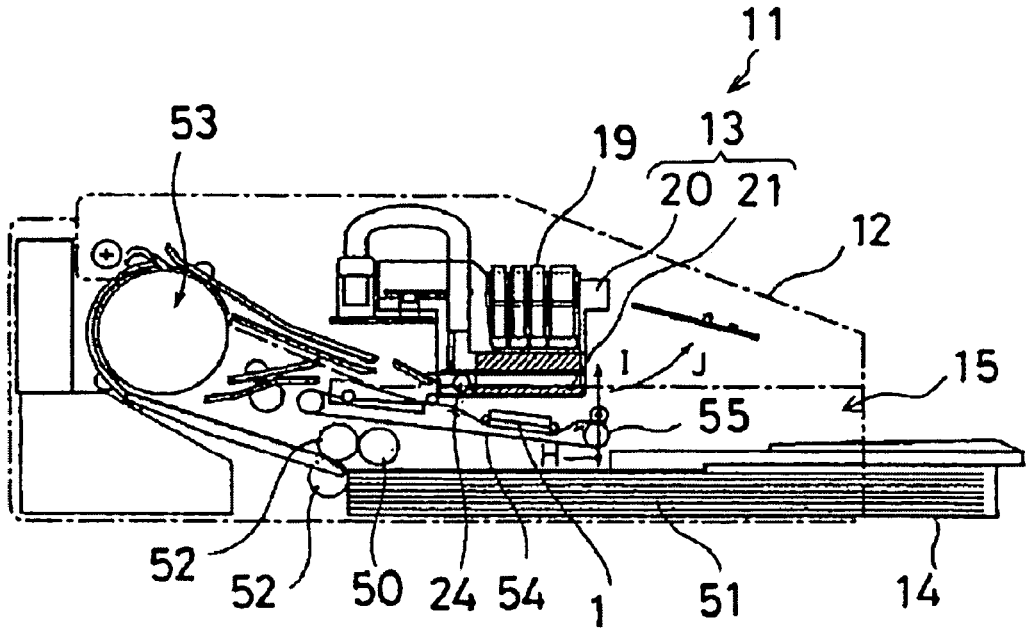
FIG. 11 is a sectional view of an internal structure of the inkjet printer shown in FIG. 5 showing a state of the head cartridge before the operation start.
Figure 12:
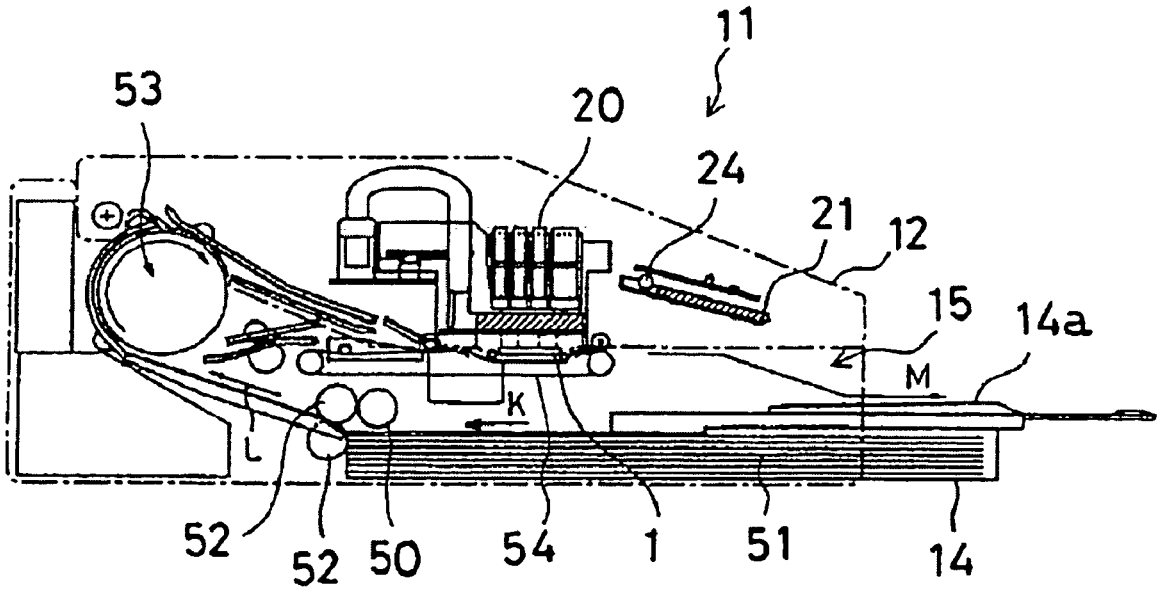
FIG. 12 is a drawing showing a state that the head cap, which has protected an ink ejection surface of the head cartridge, retracts to a cap retracted position so as to be able to print images.

FIG. 11 is a sectional view of a specific example of an internal structure of the inkjet printer 11 showing a state of the head cartridge 13 before the operation start; FIG. 12 shows a state that the head cap 21, which has protected the ink ejection surface 22 of the print head 20, retracts to the cap retracted position so as to be able to print images. The inkjet printer 11, as shown in FIG. 11, includes sheet feeding means 50 having a roller arranged at the lower front end of the recording sheet tray 14 in the inserting direction, which is mounted in the tray insertion inlet 15 provided on the lower front surface of the printer body 12 so that the recording sheet 51 stored in the recording sheet tray 14 can be supplied as needed. There is also provided separating means 52 composed of two rollers opposing each other so that the recording sheets 51 stored in an overlapped state can be separated and fed one by one. Furthermore, there is provided a reverse roller 53 arranged at an upper portion of the printer body 12 in the front conveying direction of the recording sheet 51 separated by the separating means 52 for reversing the conveying direction of the recording sheet 51.

In front of the recording sheet 51 in the conveying direction of the recording sheet 51 reversed by the reverse roller 53, belt conveying means 54 and the above-mentioned platen plate 1 are provided, and as shown in FIG. 11, in a non-printing state, the leading end 55 of the belt conveying means 54 falls in arrow H direction so as to form a large gap to the bottom surface of the print head 20. In a printing state shown in FIG. 12, the leading end 55 of the belt conveying means 54 is raised in arrow I direction and leveled so as to form a small gap to the bottom surface of the print head 20.

In a printing stop state, as shown in FIG. 11, the bottom surface of the print head 20 is covered with the head cap 21 so as to protect the ink ejection nozzles 23 from being dried to clog. The head cap 21 is also provided with the cleaning roller 24 so as to clean the ink ejection nozzles 23 following the retracting operation of the head cap 21 to a predetermined cap retracted position (see FIG. 12) before stating the printing operation.

Then, the operation of the inkjet printer 11 structured as described above will be described. First, as shown in FIG. 6, the print head 20 is hung in arrow Z direction and accommodated within the accommodation section 18 by opening the upper lid 17 on the top surface of the printer body 12. Into the tray insertion inlet 15 provided on the lower front surface of the printer body 12, the recording sheet tray 14 is inserted. At this time, as shown in FIG. 11, in the internal side of the printer body 12, the leading end 55 of the belt conveying means 54 falls in arrow H direction and the bottom surface of 20 is closed with the head cap 21 so as to have a printing stop state.

Then, upon inputting a control signal starting the printing, the head cap 21 is moved in arrow J direction of FIG. 11 so as to retract to the predetermined head cap retracted position. At this time, as shown in FIGS. 10A to 10E, the cleaning roller 24 slides through the ink ejection surface 22 of the print head 20 along with the retracting operation of the head cap 21 so as to clean the ink ejection nozzles 23.

When the head cap 21 is retracted to the predetermined head cap retracted position, the leading end 55 of the belt conveying means 54 is raised in arrow I direction of FIG. 11 so as to form a predetermined small gap between the belt conveying means 54 and the print head 20 serving a recording sheet path in a horizontal state, and then stops.

In a printing operation state shown in FIG. 12, the sheet feeding means 50 is driven and the recording sheets 51 stored in the recording sheet tray 14 in an overlapped state are supplied in arrow K direction. At this time, by the separating means 52, the recording sheets 51 are separated one by one so as to be fed in arrow L direction as needed.

The fed recording sheet 51 is reversed in a conveying direction by the reverse roller 53, and conveyed to the belt conveying means 54. Then, the recording sheet 51 is conveyed to a lower portion of the print head 20 by the belt conveying means 54.

Furthermore, when the recording sheet 51 arrives at the lower portion of the print head 20, a printing signal is input and a predetermined exothermic resistance element of the print head 20 is driven. Then, ink droplets are ejected from rows of the ink ejection nozzles 23 corresponding to four-color ink on the recording sheet 51 fed at a predetermined speed so as to form color printed images thereon.

In the inkjet printer 11 herein according to the present invention, the platen plate 1 mentioned above is located at a position opposing the ink ejection surface 22 on the bottom surface of the print head 20, so that with a plurality of ribs arranged at predetermined intervals in the width wise direction of the platen plate 1, the bottom surface of the recording sheet 51 is supported outside the region where ink droplets ejected from the respective ink ejection nozzles 23 are landed so as to define a distance between the recording sheet 51 and the ink ejection surface 22, and within the region where ink droplets ejected from the ink ejection surface 22 are landed, the rib top faces are not brought into contact with the bottom surface of the recording sheet 51. Accordingly, with a plurality of ribs arranged at predetermined intervals in the width wise direction of the platen plate 1, the flatness of the recording sheet 51 conveyed underneath the ink ejection surface 22 is assured so as to appropriately eject ink on the surface of the recording sheet 51. When the rimless printing is performed, for example, the top faces of the ribs are not contaminated with ink ejected across the peripheral end of the recording sheet 51 so as to prevent the contamination of the backside of the recording sheet 51.

Upon completion of every printing on the recording sheet 51 in such a manner, as shown in FIG. 12, the recording sheet 51 is conveyed in arrow M direction from underneath of the print head 20 so as to be discharged through the tray insertion inlet 15 serving also as a sheet outlet to the sheet receiver 14*a* on the surface of the recording sheet tray 14. Then, as shown in FIG. 11, the leading end 55 of the belt conveying means 54 falls in arrow H direction and the head cap 21 closes the bottom surface of the print head 20 so as to return to the printing stop state, stopping the operation of the inkjet printer 11.

Also, the inkjet printer 11 structured as described above, as shown in FIG. 13, is provided with a mechanism for opening the printer body 12 during maintenance so as to have a corrective action against sheet jamming. The above-mentioned belt conveying means 54 is provided with a conveying belt 57 wound around between two main pulleys 56*a* and 56*b*, a tension roller 58 provided in an intermediate portion of the belt conveying means 54 for adjusting a tension of the conveying belt 57, a guide plate and a pinch roller 60 arranged in the supply side of the recording sheet 51 to the print head 20 so as to oppose each other, and a spur roller 61 arranged in the discharge side of the recording sheet 51 so as to form a predetermined conveying route.

Figure 13:
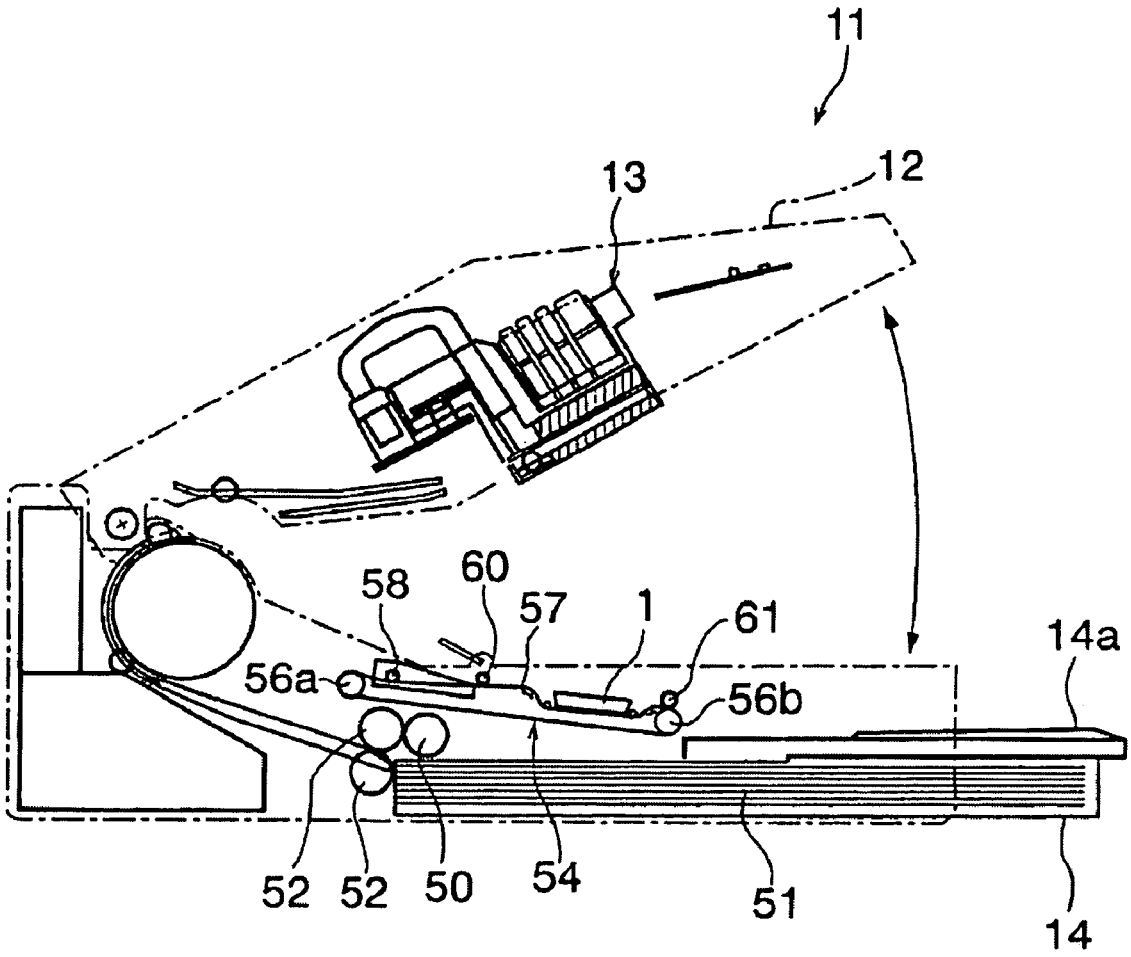
FIG. 13 is a drawing showing an opened state of a printer body during maintenance of the inkjet printer.

The attachment structure of the belt conveying means 54 to the platen plate 1 will be described in detail with reference to FIG. 19. In the belt conveying means 54 and the platen plate 1, as shown in FIGS. 11 to 13, the platen plate 1 is located so as to oppose the ink ejection surface 22 of the print head 20 (see FIG. 7) and to able to fall or ascend relative to the print head 20. The belt conveying means 54 is provided with the conveying belt 57 wound around between the two main pulleys 56*a* and 56*b*, the tension roller 58 provided in an intermediate portion of the belt conveying means 54 for adjusting a tension of the conveying belt 57, the guide plate 59 and the pinch roller 60 arranged in the supply side of the recording sheet 51 to the print head 20 so as to oppose each other, and further the spur roller 61 arranged in the discharge side of the recording sheet 51 so as to form a predetermined conveying route.

The first main pulley 56*a* and the second main pulley 56*b* form both ends of the predetermined conveying route, and to a main shaft 62 of the first main pulley 56*a*, the rotation of a motor as driving means (not shown) is transmitted via a gear so as to drive the conveying belt 57 by the first main pulley 56*a* as a driving pulley and the second main pulley 56*b* as a following pulley. The conveying belt 57 is made of a timing belt which is a transmission belt with teeth, and with the tooth, such as spur tooth, helical tooth, or double helical tooth, the conveying belt 57 can be rotated without slippage and noise.

The pinch roller 60 and the spur roller 61 are rotated by following the rotation of the conveying belt 57. The pinch roller 60 is pressed against the guide plate 59 at a predetermined pressure so as to feed the recording sheet 51 to the lower position of the print head 20 in arrow M direction by pinching it to the conveying belt 57 as shown in FIG. 19. The spur roller 61 is pressed against the second main pulley 56*b* at a predetermined pressure so as to derive the recording sheet 51 fed to the downstream side from the position of the print head 20 by pinching it to the conveying belt 57 and to convey it to the sheet outlet.

According to the embodiment, within the region where ink is ejected from the print head 20, the conveying belt 57 of the belt conveying means 54 is located in the rear of the platen plate 1 (in the lower side of FIG. 19) relative to the print head 20. At a position where the conveying belt 57 is located in the rear of the platen plate 1, route changing means (a first guide roller 63*a*, a first guide plate 64*a*, a second guide roller 63*b*, and a second guide plate 64*b*) is provided for changing the route of the conveying belt 57.

Figure 19:
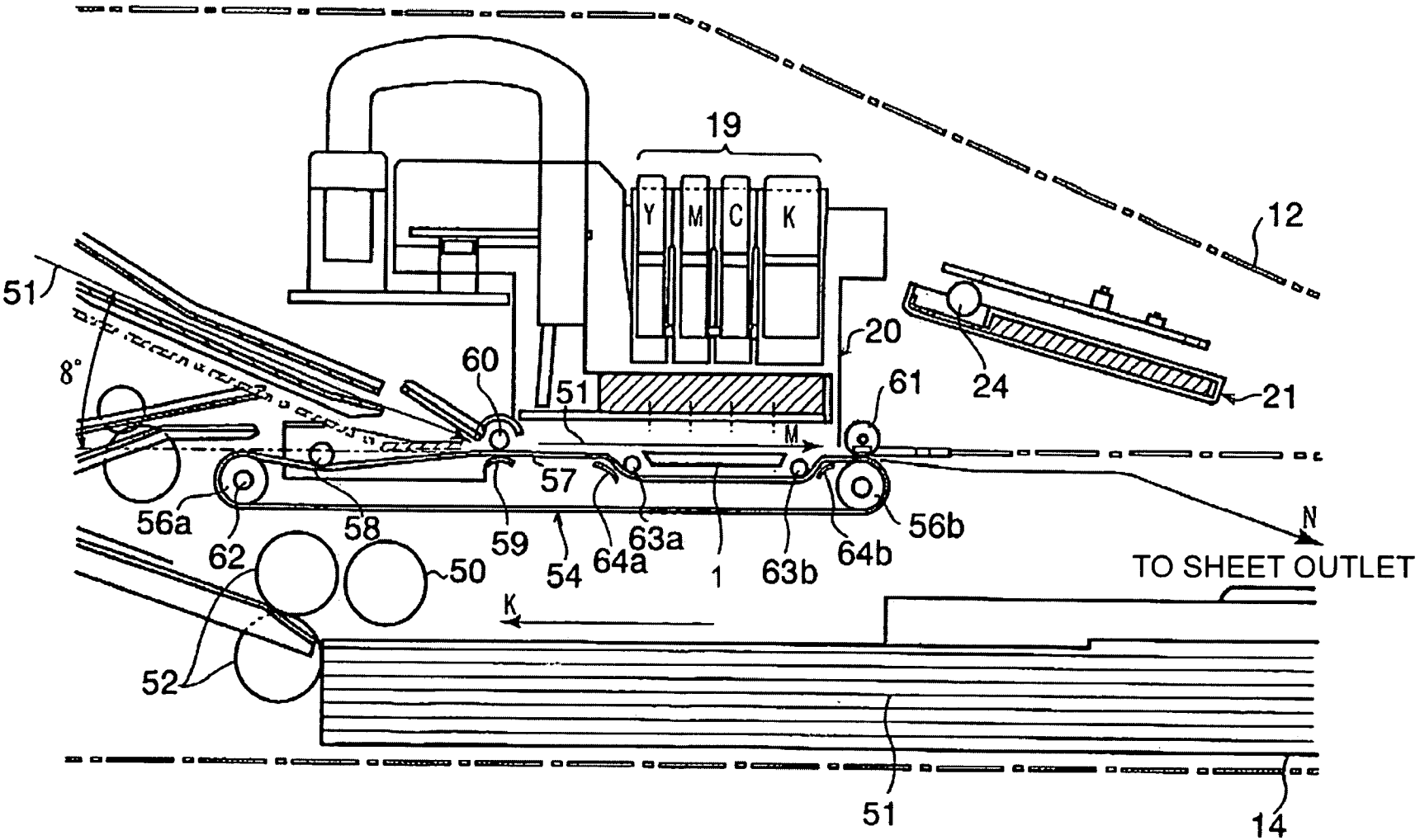
FIG. 19 is an enlarged sectional view of an essential part of a detailed attachment structure of belt conveying means and the platen plate.

That is, as shown in FIG. 19, in a state of the platen plate 1 attached using a frame for supporting the belt conveying means 54, along the conveying route of the conveying belt 57 located at the lower position of the print head 20, the first guide roller 63*a* and the first guide plate 64*a* are provided in the vicinity of the supply side end of the recording sheet 51 to the platen plate 1 while the second guide roller 63*b* and the second guide plate 64*b* are provided in the vicinity of the discharge side end of the recording sheet 51 from the platen plate 1. By guiding with the first guide roller 63*a* and the first guide plate 64*a*, the route of the conveying belt 57 is changed in the near side of the supply side end of the recording sheet 51 by allowing the route to hide into the rear (lower side) of the platen plate 1 while by guiding with the second guide roller 63*b* and the second guide plate 64*b*, the route of the conveying belt 57 is changed in the rear of the discharge end of the recording sheet 51 by floating the route at the upper position of the platen plate 1.

Accordingly, within the region where ink is ejected from the print head 20, the conveying belt 57 is rotated by hiding into the rear (lower side) from the platen plate 1, so that ink ejected from the print head 20 cannot adhere on the conveying belt 57.

Figure 20:
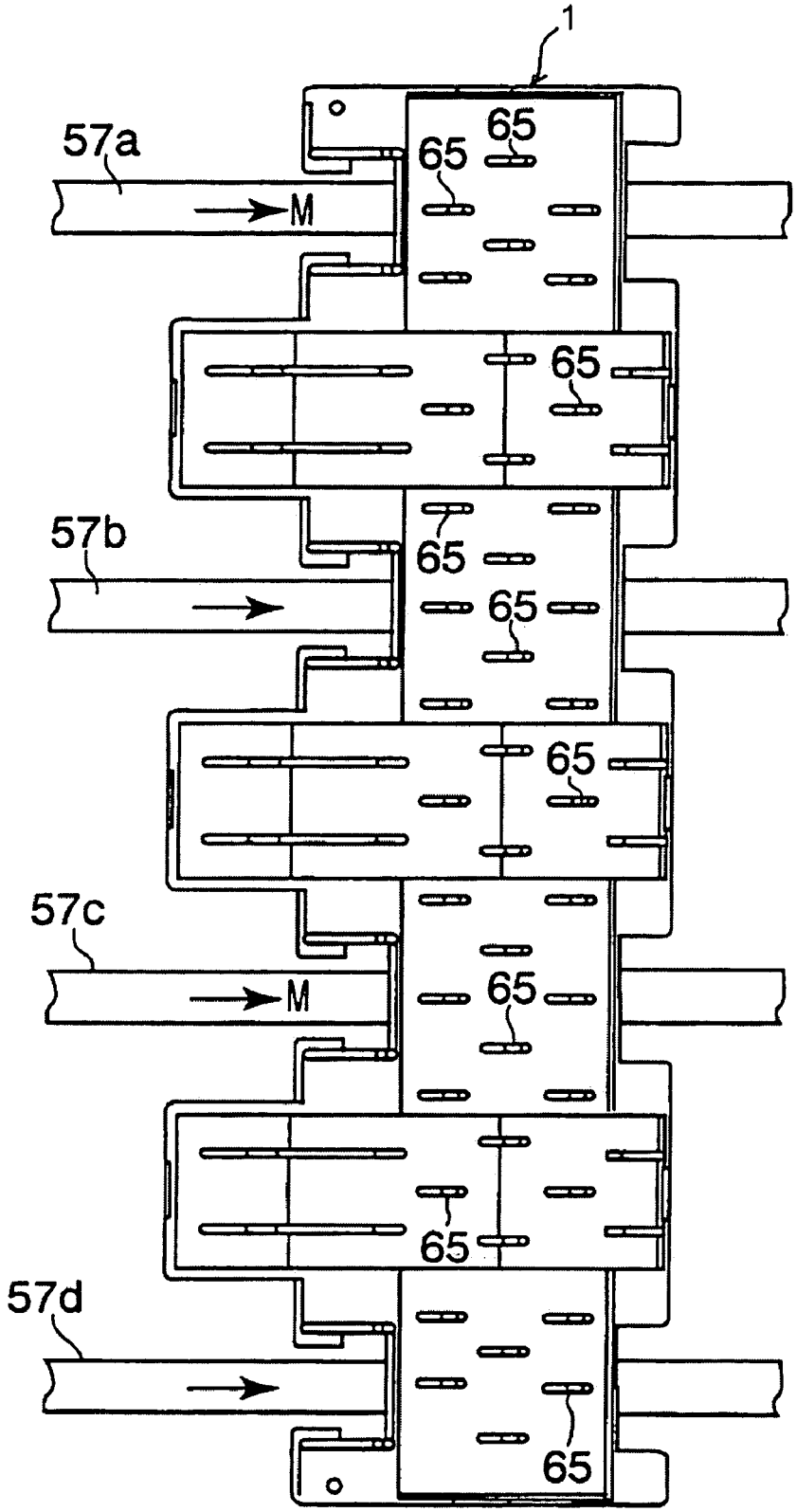
FIG. 20 is a plan view of the platen plate.

A plurality of the conveying belts 57, as shown in FIG. 20, are arranged at predetermined intervals in a direction approximately perpendicular to the conveying direction M of the recording sheet 51. FIG. 20 is a plan view of the platen plate 1, and the first guide roller 63*a* is provided in the left side of the drawing while the second guide roller 63*b* is provided in the right side of the drawing. In the drawing, four slender conveying belts 57*a*, 57*b*, 57*c*, and 57*d* are routed at predetermined intervals in a direction approximately perpendicular to the longitudinal direction of the recording sheet 51. The present invention is not limited to the four routed conveying belts, so that another number of the conveying belts 57 may be arranged. The invention is not limited to the slender belts, so that one wide belt with the same or more width as that of the recording sheet 51 may be arranged.

Figure 14:
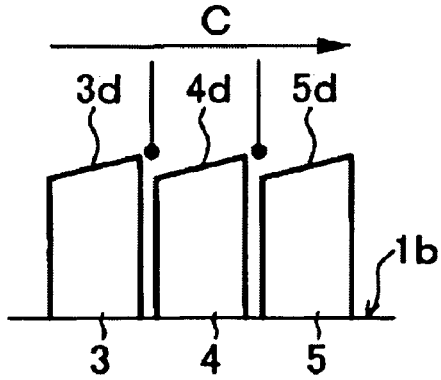
FIG. 14 is a schematic sectional view of a second embodiment of the platen plate showing ribs including inclined surfaces formed at the upstream end with a straight section.

FIG. 14 is a schematic sectional view showing a second embodiment of the present invention. According to the embodiment, the platen plate 1 is provided with a plurality of ribs 3 to 5 raised from the bottom surface 1*b* of the platen plate 1 so as to extend in the conveying direction of the recording sheet 51. The plurality of the ribs 3 to 5 are provided with inclined surfaces 3*d* to 5*d* formed at the upstream end in the conveying direction of the recording sheet 51 with a processed end face having a straight section without a top face supporting the recording sheet 51, so that the recording sheet 51 is supported by top sides formed at the downstream end, and the top sides at the downstream end are substantially the same in height. This case has the same advantages as those shown in FIGS. 2 and 3.

Figure 15:
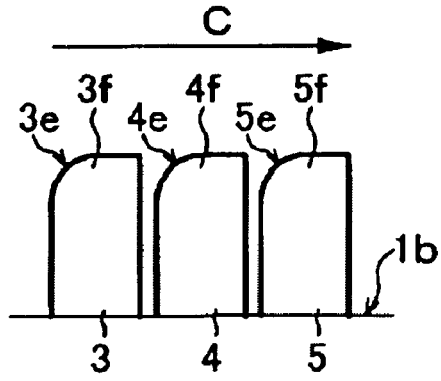
FIG. 15 is a schematic sectional view of a third embodiment of the platen plate showing ribs including curved surfaces formed at the upstream end with a curved section.

FIG. 15 is a schematic sectional view showing a third embodiment of the present invention. According to the embodiment, the platen plate 1 is provided with a plurality of ribs 3 to 5 raised from the bottom surface 1*b* of the platen plate 1 so as to extend in the conveying direction of the recording sheet 51. The plurality of the ribs 3 to 5 are provided with curved surfaces 3*e* to 5*e* formed at the upstream end in the conveying direction of the recording sheet 51 with a processed end face having a straight section (¼ circular section). This case also has the same advantages as those shown in FIGS. 2 and 3.

Figure 16:
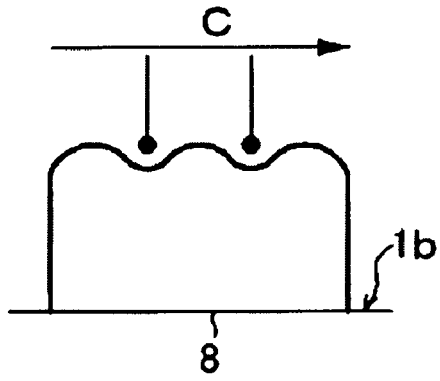
FIG. 16 is a schematic sectional view of a fourth embodiment of the platen plate showing a rib having no notch but a continuously wavelike top face.

FIG. 16 is a schematic sectional view showing a fourth embodiment of the present invention. According to the embodiment, a rib 8 raised from the bottom surface 1*b* of the platen plate 1 has no notch but a continuously wavelike top face, and the top face in the region where ink droplets do not adhere is formed low so that the region is not brought into contact with the recording sheet 51. This case also has the same advantages as those shown in FIGS. 2 and 3.

Figure 17:
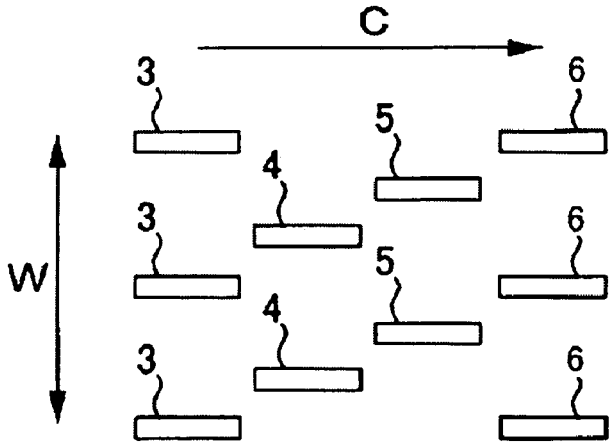
FIG. 17 is a plan view of a fifth embodiment of the platen plate showing another arrangement of ribs.

FIG. 17 is a schematic sectional view showing a fifth embodiment of the present invention. According to the embodiment, in the ribs 3 to 6 of the platen plate 1, the row of second ribs 3, the row of third ribs 4, and the row of fourth ribs 5 are arranged not to overlap with each other in the conveying direction of the recording sheet 51 shown in arrow C. The row of fifth ribs 6 and the row of the second ribs 3 are arranged to overlap with each other in the conveying direction of the recording sheet 51. Thereby, the recording sheet 51 is supported with the ribs 3 to 6 arranged as mentioned above, so that the flatness in the width wise direction is secured so as to appropriately eject ink on the surface of the recording sheet 51.

Figure 18:
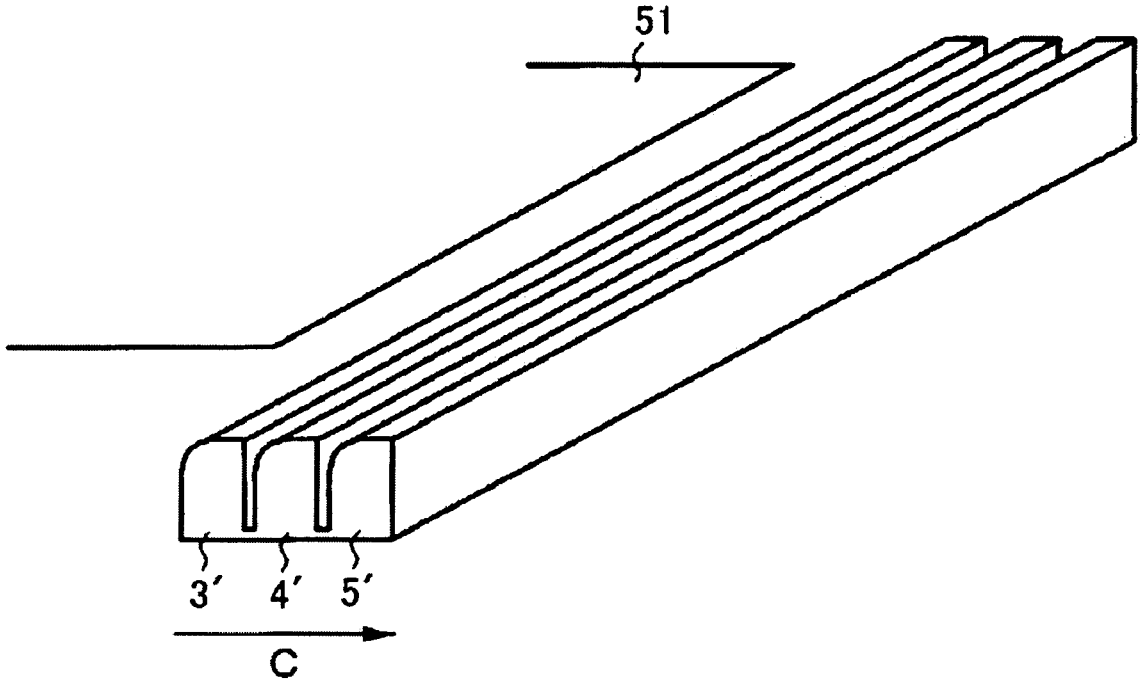
FIG. 18 is a perspective view of a sixth embodiment of the platen plate showing ribs formed so as to continuously extend in the width wise direction of a recording sheet.

FIG. 18 is a schematic sectional view showing a sixth embodiment of the present invention. According to the embodiment, ribs 3' to 5' of the platen plate 1 are formed so as to continuously extend in the width wise direction of the recording sheet 51. In this case, the recording sheet 51 is supported with the ribs 3' to 5' continuously formed in the entire width wise direction of the recording sheet 51, so that the perfect flatness in the width wise direction can be secured, so as to appropriately eject ink on the surface of the recording sheet 51. The ribs 3' to 5' of the platen plate 1 are continuously formed in the entirely width wise direction of the recording sheet 51 in FIG. 18; however, the present invention is not limited to this, so that the ribs 3' to 5' may also be formed in a width smaller than the entire width of the recording sheet 51 so as to continuously extend in the width wise direction only within a predetermined space.

In the above-description, the inkjet printer is exemplified; however, the present invention is not limited to this, so that any apparatus may be incorporated as long as it ejects liquid contained in a liquid chamber from a liquid ejection nozzle as liquid droplets. For example, an inkjet image forming apparatus, such a facsimile apparatus and a copying machine, may be incorporated.

Also, the liquid ejected from the ink ejection nozzles 23 is not limited to ink, so that an ejection apparatus for other liquids may be incorporated as long as it ejects liquid in the liquid chamber so as to form dot rows or dots. For example, a liquid ejection apparatus for ejecting a solution containing a DNA on a pallet in DNA identification may be incorporated.

The invention claimed is:

1. A liquid ejection apparatus comprising:

a liquid ejection head having a plurality of nozzles positioned on a liquid ejection surface, the liquid ejection surface located on a bottom end of the liquid ejection head;

a platen plate opposing the liquid ejection surface;

a recording object supported by the platen plate to receive liquid droplets ejected from the plurality of nozzles; and a conveying unit having a plurality of conveying belts arranged at predetermined intervals in a direction substantially perpendicular to a conveying direction of the recording object along a predetermined route to convey the recording object from a supply side of the liquid ejection head to a discharge side thereof, and within a region where the liquid droplets are ejected from the liquid ejection head, the plurality of conveying belts of the conveying unit is located below a bottom end of the platen plate away from the liquid ejection heads, wherein, the platen plate includes a plurality of ribs projecting upwardly from the bottom end of the platen plate, the plurality of ribs extend in the conveying direction of the recording object and are arranged at predetermined intervals along a width direction of the recording object, and the bottom end has a crenellated shape such that the plurality of ribs is shorter in depth in portions of the platen plate where the plurality of conveying belts is located below the bottom end of the platen plate, the recording object is supported by upper surfaces of the ribs outside of a region where the ejected liquid droplets land on the ejection object, thereby defining a distance between the recording object and a liquid ejection surface, and the upper surfaces of the ribs are inclined to increase in height in the conveying direction or the ribs do not exist in a region where the ejected liquid droplets land so that the upper surfaces of the ribs are not in contact with the recording object.

2. The apparatus according to claim 1, further comprising a route changing unit arranged at a position where the plurality of conveying belts is located below the bottom end of the platen plate to change the route of the plurality of conveying belts.

* * * * *